US008720239B2

(12) United States Patent
Crass et al.

(10) Patent No.: US 8,720,239 B2
(45) Date of Patent: May 13, 2014

(54) TOOL BOX LOCKING MECHANISMS FOR REMOTE ACTIVATION

(75) Inventors: Matthew M. Crass, Pleasant Prairie, WI (US); Jon M. LaRue, Lake Villa, IL (US); Mark T. Gordon, Round Lake, IL (US); John J. Landree, Pleasant Prairie, WI (US); Robert Keith Folkestad, II, Des Moines, IA (US)

(73) Assignee: Snap-on Incorporated, Kenosha, WI (US)

( * ) Notice: Subject to any disclaimer, the term of this patent is extended or adjusted under 35 U.S.C. 154(b) by 197 days.

(21) Appl. No.: 13/019,398

(22) Filed: Feb. 2, 2011

(65) Prior Publication Data

US 2011/0185779 A1 Aug. 4, 2011

Related U.S. Application Data

(60) Provisional application No. 61/300,773, filed on Feb. 2, 2010, provisional application No. 61/300,775, filed on Feb. 2, 2010.

(51) Int. Cl.
*E05B 47/00* (2006.01)
*B65D 55/14* (2006.01)

(52) U.S. Cl.
USPC ..... 70/280; 70/256; 70/257; 70/279.1; 70/277; 70/278.7; 70/283; 70/282

(58) Field of Classification Search
USPC ..... 70/256, 257, 279.1, 277, 278.7, 70/280–283, DIG. 62
See application file for complete search history.

(56) References Cited

U.S. PATENT DOCUMENTS

| | | | | | |
|---|---|---|---|---|---|
| 1,007,627 | A | * | 10/1911 | Arens | 70/343 |
| 3,304,755 | A | | 2/1967 | Johnstone | |
| 3,990,277 | A | * | 11/1976 | Mullich | 70/107 |
| 4,838,056 | A | | 6/1989 | Weinerman et al. | |
| 5,058,258 | A | * | 10/1991 | Harvey | 29/401.1 |
| 5,113,675 | A | | 5/1992 | Uyeda | |
| 5,123,691 | A | * | 6/1992 | Ginn | 296/37.1 |
| 5,152,161 | A | * | 10/1992 | Lee | 70/127 |
| 5,351,512 | A | | 10/1994 | Pearlman | |
| 5,493,881 | A | * | 2/1996 | Harvey | 70/277 |
| 5,531,086 | A | | 7/1996 | Bryant | |
| 5,575,515 | A | * | 11/1996 | Iwamoto et al. | 292/341.17 |
| 5,640,863 | A | * | 6/1997 | Frolov | 70/283 |

(Continued)

OTHER PUBLICATIONS

International Preliminary Report on Patentability, dated Aug. 8, 2012; 1 page.

(Continued)

*Primary Examiner* — Lloyd Gall
*Assistant Examiner* — Ifeolu Adeboyejo
(74) *Attorney, Agent, or Firm* — Seyfarth Shaw LLP

(57) ABSTRACT

An improved method of rotating the lockrod of a tool storage unit to the "locked" or "unlocked" position by use of a linear actuator to rotate the lockrod actuator, where the linear actuator operates electrically, allowing for control by any remotely or automatically operated system. The tool storage unit locking mechanisms include a center-neutral key position that rotates 90 degrees in either direction from center to lock and unlock the unit. This design allows a standard key to operate the locking mechanism, but also allows a secondary mechanism (such as an electromagnetically driven mechanism) to directly operate the lock. Due to its specifics, the design would also allow for retrofitability.

12 Claims, 13 Drawing Sheets

(56) References Cited

U.S. PATENT DOCUMENTS

| | | | | |
|---|---|---|---|---|
| 5,720,535 | A * | 2/1998 | Mehman | 312/219 |
| 5,727,835 | A | 3/1998 | Krush et al. | |
| 5,737,950 | A * | 4/1998 | Yun-Bin | 70/379 R |
| 5,782,118 | A | 7/1998 | Chamberlain et al. | |
| 5,911,460 | A * | 6/1999 | Hawkins et al. | 292/254 |
| 6,116,067 | A | 9/2000 | Myers et al. | |
| 6,282,931 | B1 * | 9/2001 | Padiak et al. | 70/279.1 |
| 6,326,754 | B1 * | 12/2001 | Mullet et al. | 318/480 |
| 6,374,649 | B1 | 4/2002 | Holcomb et al. | |
| 6,543,264 | B2 * | 4/2003 | Frolov | 70/222 |
| 6,807,834 | B2 | 10/2004 | Tsai | |
| 6,874,828 | B2 * | 4/2005 | Roatis et al. | 292/199 |
| 7,040,675 | B1 | 5/2006 | Ott et al. | |
| 7,096,697 | B2 | 8/2006 | Keightly | |
| 7,516,632 | B2 | 4/2009 | Poppell | |
| 7,523,969 | B2 * | 4/2009 | Thornton et al. | 292/172 |
| 8,141,400 | B2 * | 3/2012 | Sorensen et al. | 70/279.1 |
| 8,146,394 | B2 * | 4/2012 | Krueger | 70/279.1 |
| 2001/0029760 | A1 | 10/2001 | Viney | |
| 2004/0011097 | A1 | 1/2004 | Jeffers | |
| 2004/0201277 | A1 | 10/2004 | Hentsch et al. | |
| 2006/0112746 | A1 * | 6/2006 | Thompson | 70/257 |
| 2007/0001467 | A1 | 1/2007 | Muller et al. | |
| 2007/0157684 | A1 | 7/2007 | Bogdanov et al. | |
| 2007/0234052 | A1 | 10/2007 | Campisi | |
| 2009/0217714 | A1 | 9/2009 | O'Leary et al. | |

OTHER PUBLICATIONS

PCT Written Opinion of the International Searching Authority, dated Mar. 30, 2011; 4 pages.

International Search Report and Written Opinion of the International Searching Authority, International Application No. PCT/US2011/023435, Mar. 30, 2011.

* cited by examiner

TOOL BOX LOCKING MECHANISMS FOR REMOTE ACTIVATION

RELATED APPLICATIONS

This application claims the priority of, and hereby incorporates by reference, provisional application Ser. No. 61/300,773 filed Feb. 2, 2010 and provisional application Ser. No. 61/300,775 filed Feb. 2, 2010.

TECHNICAL FIELD OF THE DISCLOSURE

The present device relates to locking mechanisms. Particularly, the present disclosure relates to locking mechanisms for tool boxes that allow a standard key to operate the lock, but also allow a secondary mechanism (such as an electromagnetically driven mechanism) to directly operate the lock.

BACKGROUND OF THE DISCLOSURE

Standard commercial tool storage units are typically comprised of a housing body having a plurality of compartments or drawers that include devices to prevent or limit access to those compartments or drawers by various means, including a simple key lock on the outside of the housing body. Too often, storage units of this type prove difficult to make and maintain with simplicity and to adapt locking devices to different types of tool storage units. Moreover, keys for these locking systems are often lost or misplaced, or fall into the wrong hands that can result in the loss of extremely expensive and varied tools and other commercial devices stored in those units, especially if there are no effective ways to remedy such a situation without being physically present where the particular locked tool storage unit may be located.

SUMMARY OF THE DISCLOSURE

There is disclosed herein a method of moving the lockrod of a tool storage unit between the "locked" and "unlocked" positions by use of an electromechanical actuator to rotate the lockrod actuator. The electromechanical actuator operates electrically, allowing for control by various remotely or automatically operated systems.

The disclosure demonstrates several alternate mechanisms for rotating the lockrod actuator. In one embodiment, the electromechanical actuator may a linear actuator that is configured to rotate the lockrod actuator. In another embodiment the electromechanical actuator may be a rotary actuator such as an electric motor. In this embodiment, the lockrod actuator includes external gear teeth along a portion of its edge, allowing rotation by gear or gear train connected to the rotary actuator, for example. Aspects of the disclosure further include a number of remote or automatic systems for electronic control of the disclosed mechanisms.

In an illustrative embodiment, the tool box locking mechanisms include a center-neutral key position that rotates 90 degrees in either direction from center to lock and unlock the box. This design allows a standard key to operate the lock, but also allows a secondary mechanism (such as an electromagnetically driven mechanism) to directly operate the lock. Due to its specifics, the design would also allow for retrofitability.

While showing some different geometries, each variation of the embodiment generally shows a plate rotatable relative to the key mechanism. The plate can include one or two pairs of stops for using the key mechanism to rotate the plate. When two pairs of stop are used, one pair is for rotating the plate in a lock direction and a second is for rotating the plate in the unlock direction. The plate is free to move relative to the key mechanism between the stops, and such allows the electromagnetic mechanism to rotate the plate without interference with or from the key mechanism. In at least one form, the stops are formed in separate openings, while other forms show the stops formed as shoulders within a single opening. Conversely, the electromagnetic mechanism can include a clutch so that operation of the key does not receive interference from the mechanism.

Further, the plates of an embodiment can be connected to forms of the electromagnetic mechanism, such as a described linear actuator. Generally speaking, the electromagnetic mechanism is connected to the plate by a linking arm or plate such that actuation of the electromagnetic mechanism advances or retracts the linking arm. Such advancement or retraction causes rotation of the plate between the locked and unlocked positions. A support pin can be provided in an embodiment to maintain the linking arm at a position off-center from the center of the plate.

In the illustrated forms, the plate is also operatively connected to a lock rod that is rotated to release the tool box compartments. In an illustrative embodiment, the lock rod is elongated along an axis of rotation, one end having a parallel and offset portion that is received into the plate while the second end cooperates with a release mechanism for the drawers. The offset portion is rotatable by rotation of the plate so that the rod rotates about the axis. This causes the second end to shift the release mechanism. The release mechanism can be a crossrod shifted laterally along its axis to shift lockbars out of engagement with drawer hooks. These and other aspects of the disclosure may be understood more readily from the following description and the appended drawings.

In one illustrative embodiment the present disclosure includes a locking mechanism that may be used for locking a tool box, for example. The lock mechanism includes a lock cylinder and an actuator plate attached to the lock cylinder. The lock cylinder may be configured for retrofit in place of a standard lock cylinder. The actuator plate is configured for rotation from a first angular displacement to a second angular displacement by operation of a lock cylinder and by operation of an electromechanical actuator. The actuator plate also includes a lock rod drive portion configured for engagement with a lock rod and configured to move the lock rod from a first orientation to a second orientation.

In an illustrative embodiment, the locking mechanism includes a drive plate attached to an output portion of the lock cylinder between the lock cylinder and the actuator plate. The drive plate includes at least one projection and is configured for rotation with the output portion. The actuator plate includes a keyway for receiving the projection. The projection and keyway are cooperatively configured to angularly displace the actuator plate from an unlocked orientation to a locked orientation in response to a first rotation of the drive plate from a neutral position in a locking direction, and to allow the actuator plate to remain in the locked orientation in response to subsequent rotations of the drive plate in the locking direction. The projection and keyway are further configured to angularly displace the actuator plate from a locked orientation to an unlocked orientation in response to a first rotation of the drive plate from a neutral position in an unlocking direction, and to allow the actuator plate to remain in the unlocked orientation in response to subsequent rotations of the drive plate in the unlocking direction.

In an illustrative embodiment, the actuator plate may include an attachment point configured for attachment to a linear actuator linkage to cause rotation the actuator plate in response to a substantially linear displacement of the linear actuator linkage. Alternatively, the actuator plate may include gear teeth for engagement with a gear train output of a rotary actuator to cause rotation of the actuator plate in response to a rotation of the gear train.

In an illustrative embodiment, the electromechanical actuator is configured to rotate the actuator plate. Power supply circuitry in communication with the electromechanical actuator includes polarity reversing circuitry configured to provide a voltage having a first polarity for driving the electromechanical actuator in a first direction and to provide voltage having a second polarity for driving the electromechanical actuation a second direction. In an embodiment, the power supply circuitry may be configured for wireless power transmission of power to the electromechanical actuator.

In an illustrative embodiment, control circuitry in communication with the power supply circuitry is configured for receiving a command signal and for causing the power supply circuitry to reverse polarity of the voltage in response to receiving the command signal. Actuation command circuitry in wireless communication with the control circuitry is configured for transmitting the command signal in response to an actuation event.

The actuation command circuitry may include proximity sensing circuitry, passive keyless entry circuitry, wireless network circuitry or biometric control circuitry, for example. In an embodiment, radio signal strength indication (RSSI) circuitry is configured to detect a distance between a location of the lock mechanism and a user location. The actuation command circuitry may be configured for transmitting an unlock command to the control circuitry in response to detecting the distance within a first range, and for transmitting a lock command to the control circuitry in response to detecting the distance within a second range.

Another embodiment of the present disclosure includes a method for securing a container. The method includes electromechanically actuating a lock mechanism configured to lock the container in which the lock mechanism includes a key operated lock. A command signal is transmitted to control the electromechanical actuation in response to an event such as a network command, a biometric sensor output, a passive keyless entry system output, or a proximity sensing output.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages, should be readily understood and appreciated.

DETAILED DESCRIPTION

Figure 1:
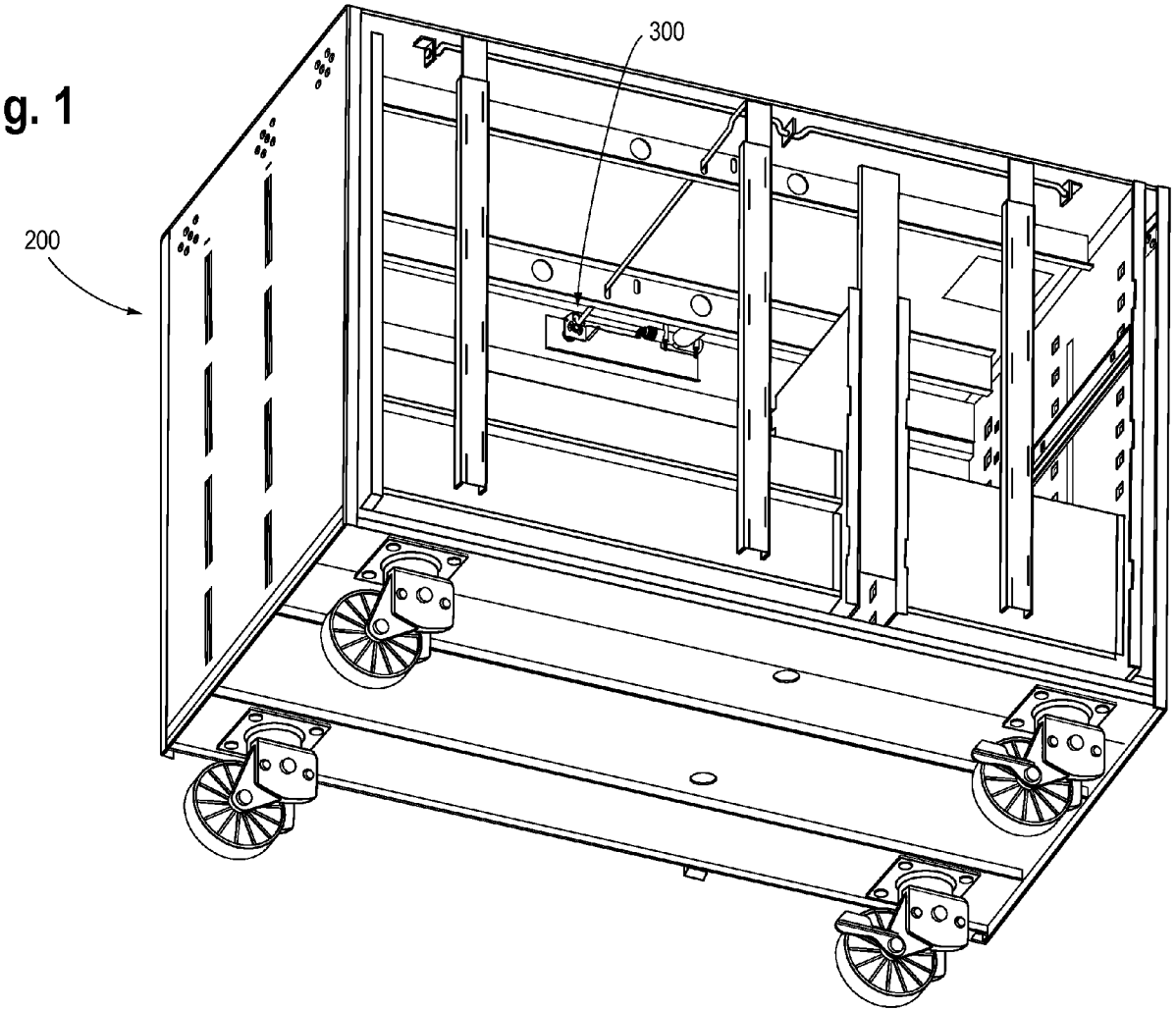
FIG. 1 is a perspective view of a tool storage unit of the roll cab variety (with drawers removed) with a locking mechanism for remote activation in accordance with an embodiment of the present disclosure.

While this disclosure is susceptible of embodiments in many different forms, there is shown in the drawings and will herein be described in detail an illustrative embodiment of the disclosure with the understanding that the present disclosure is to be considered as an exemplification of the principles of the disclosure and is not intended to limit the broad aspect of the disclosure to embodiments illustrated.

Figure 2:
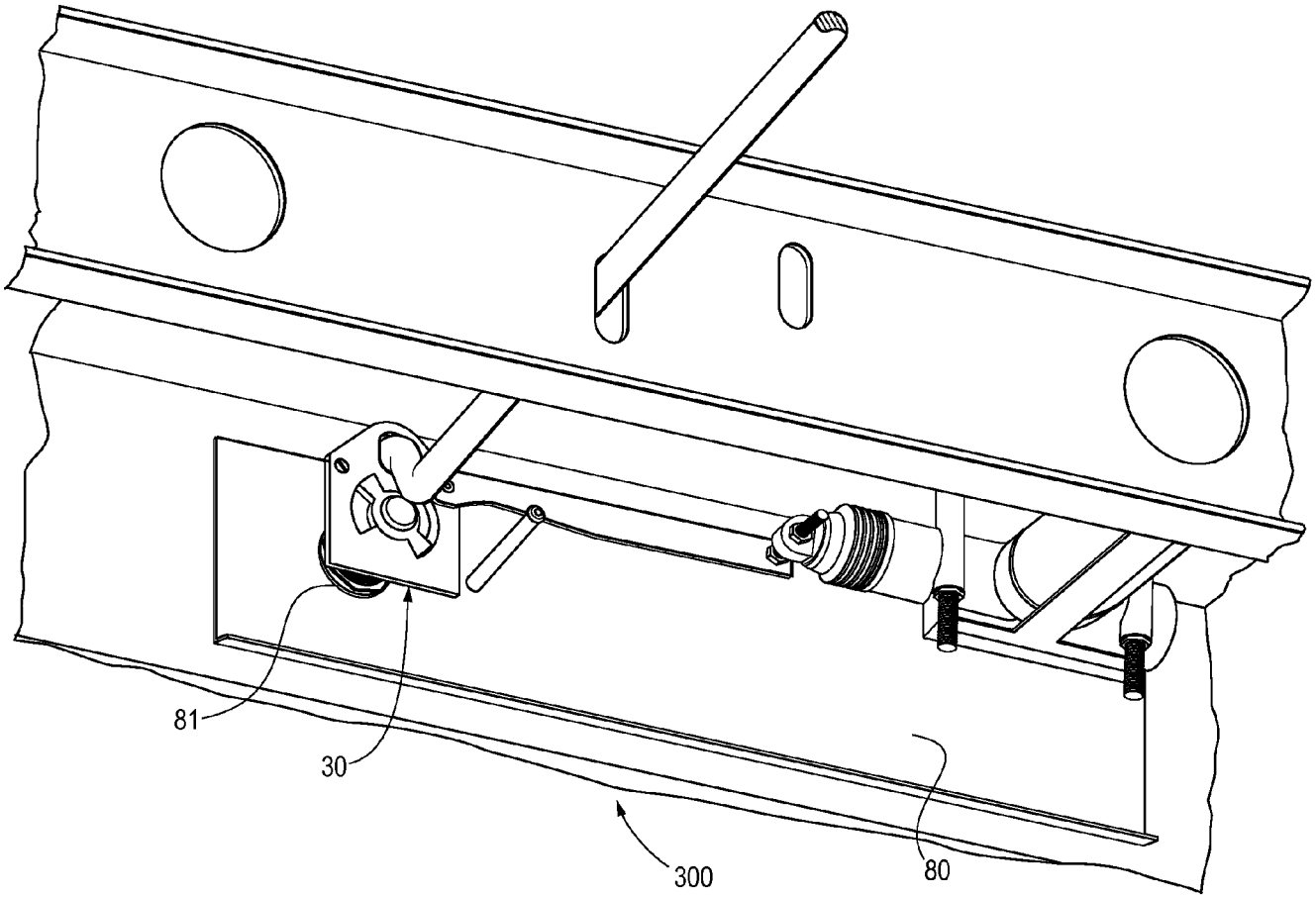
FIG. 2 is a close-up perspective view of the locking mechanism in FIG. 1.
Figure 3A:
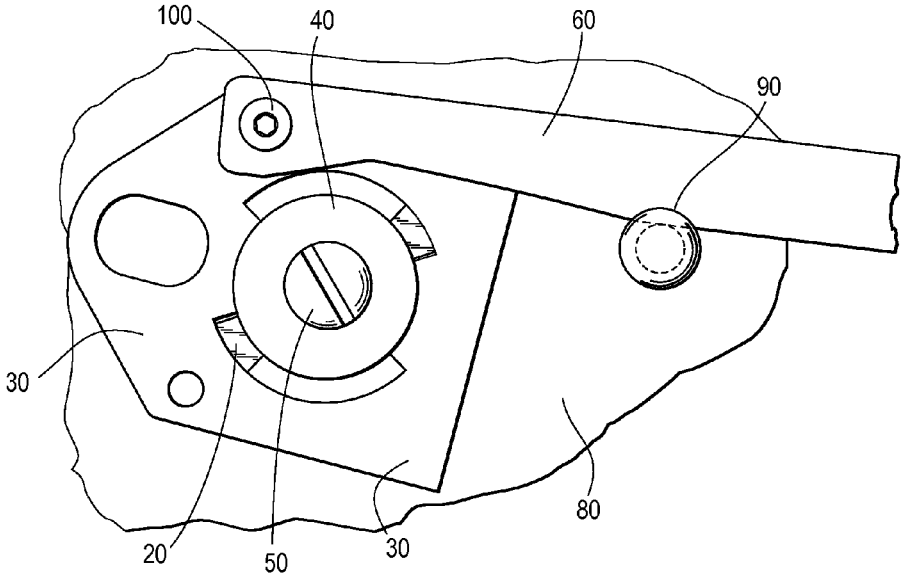
FIGS. 3A to 3B are a close-up perspective view of the locking mechanism in FIG. 3 in "locked" and "unlocked" positions, respectively.
Figure 3B:
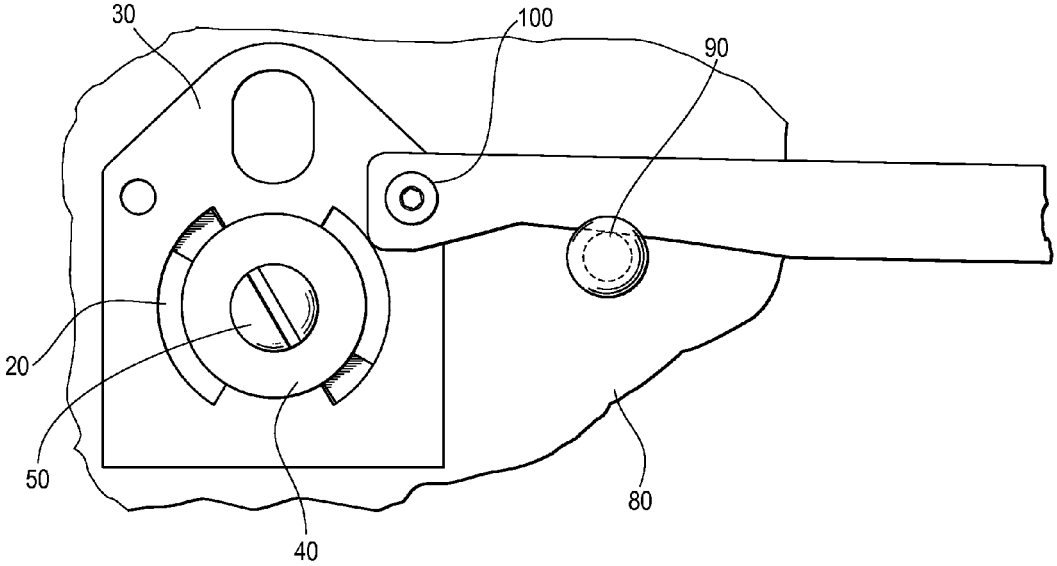

Referring to FIGS. 1-2, there is illustrated a tool storage unit 200 of the roll cab variety, viewed with its drawers removed, with a locking mechanism 300 for remote activation, in accordance with an embodiment of the present disclosure, for rotating lockrod actuator 30 in FIG. 2 to push lockrod 120 of the tool storage unit into the "locked" position, or to pull lockrod 120 into the "unlock" position, to allow locking and unlocking of the unit by a key and/or a remote system. Locking mechanism 300 is shown in FIG. 2 on mounting bracket 80 so the mechanism is positioned properly in the unit. While the invention is shown in a roll cab, it will be understood that the present invention can utilized with any type of unit that requires locking and unlocking.

Figure 4A:
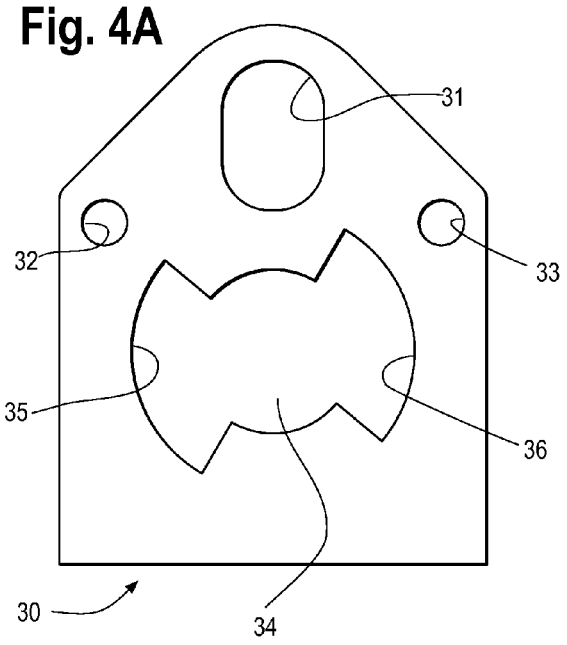
FIGS. 4A to 4C are plan views of several of the components in the locking mechanism in FIG. 1.
Figures 1, 4B:
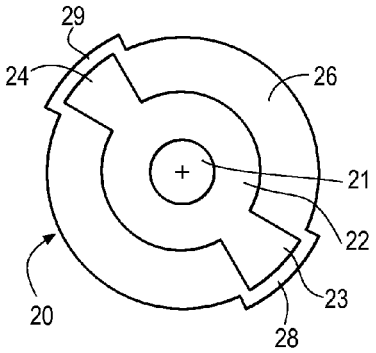
Figures 2, 4B:
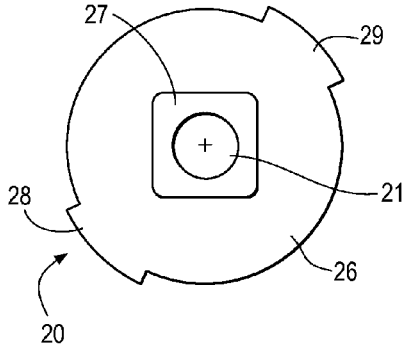
Figures 3, 4B:
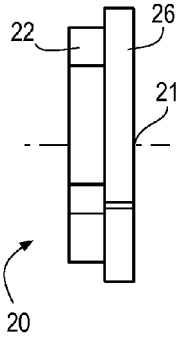

FIGS. 3 and 6 illustrate in more detail an illustrative locking mechanism 300, which includes lock cylinder 10 (with a center-neutral position and +/−90 degree rotation capability), drive plate 20, lockrod actuator 30, washer 40, screw 50, linkage arm 60 (which connects lockrod actuator 30 to linear actuator 70), electric motor (not shown, but can be contained within the linear actuator), mounting bracket 80 (with lock cylinder hole (not shown) for accepting lock cylinder 10), pin 90 (which prevents over-rotation of lockrod actuator 30 when a key (not shown) is inserted in lock cylinder 10 and rotated counter-clockwise towards linear actuator 70), first hinge point 100 (linking lockrod actuator 30 and linkage arm 60), and second hinge point 105 (linking linkage arm 60 and linear actuator 70).

In operation, linear actuator 70, through linkage arm 60, extends or retracts (depending upon the polarity of the voltage applied to the motor terminals of a motor, for example) to rotate lockrod actuator 30, which pushes lockrod 120 into the "locked" position, or pulls the lockrod into the "unlocked" position.

As can be seen further in FIGS. 2 and 3, mounting bracket 80 retains linear actuator 70 in the correct position relative to the individual components of locking mechanism 300, and mounts the entire locking mechanism 300 to the tool storage unit 200 through a lock cylinder hole 81 in mounting bracket 80. This permits assembly of locking mechanism 300 without requiring additional holes or brackets added to tool storage unit 200, making the locking mechanism 300 easy to retrofit to units already in the possession of end users. Although the size of mounting bracket 80 shown herein is optimized for installation in such tool storage units as, for example the Masters and EPIQ Series of Snap-On® brand roll cabinets, it will be appreciated that different configurations can accommodate the use of locking mechanism 300 in lockers, top chests, and other accessories, or the Classic and Heritage Series of Snap-On® brand tool storage units, as well as those of other makers or suppliers.

Figure 4C:
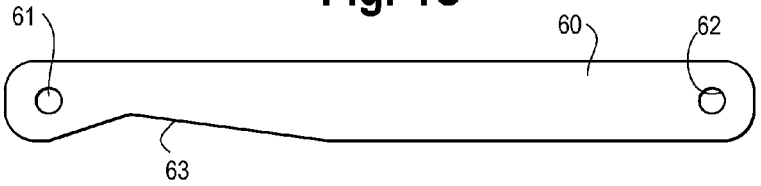
Figure 5:
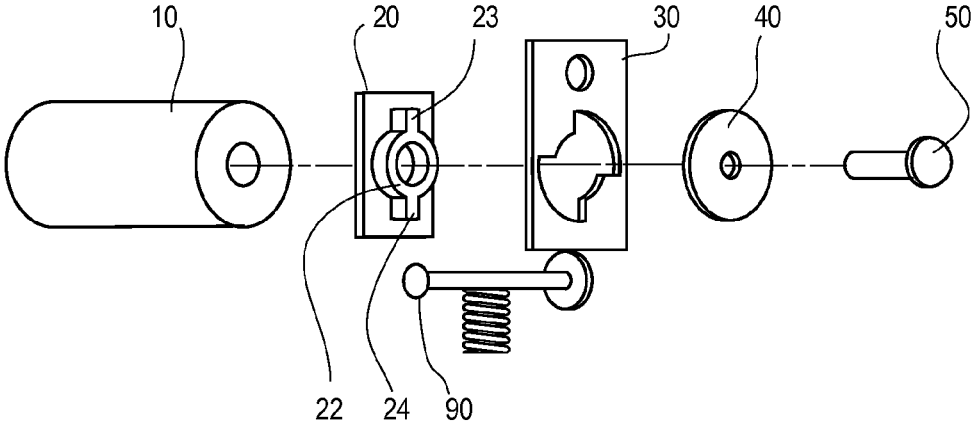
FIG. 5 is an exploded view of several of the component parts in the locking mechanism of FIG. 1.

FIGS. 4A-4C and FIG. 5 illustrate more detail concerning several of the components of the locking mechanism 300. In FIG. 4A, lockrod actuator 30 includes an oblong opening 31 (for receiving the engagement End 122 of lockrod rod 120, shown in more detail in FIG. 6), side openings 32, 33 (for receiving first hinge point 100, shown in more detail in FIGS. 4 and 6), and central opening 34 with lateral Butterfly Openings 35, 36 (for receiving and interacting with drive plate 20, shown in more detail in FIG. 3). FIGS. 4B-1 to 4B-3 show the back, front, and side views, respectively, of drive plate 20, which includes central opening 21, back circular portion 22 projecting from the plane of drive plate 20, back butterfly projections 23, 24, front circular portion 26, front square portion 27 (to interface with lock cylinder 100, as shown in FIG. 5), and front butterfly extension tabs 28, 29. FIG. 4C shows linkage arm 60 with first opening 61 for first hinge point 100 and second opening 62 for second hinge point 105.

Figure 6A:
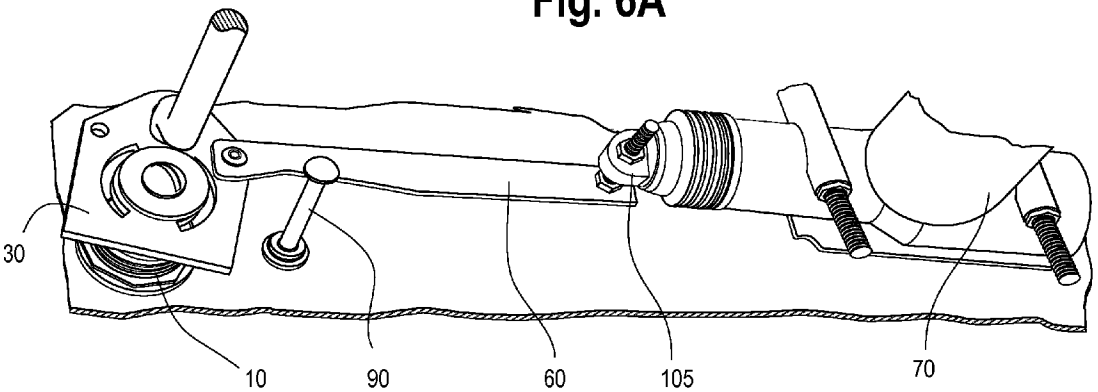
FIGS. 6A to 6B are upper-looking perspective views of the locking mechanism in FIG. 3 in "locked" and "unlocked" positions.
Figure 6B:
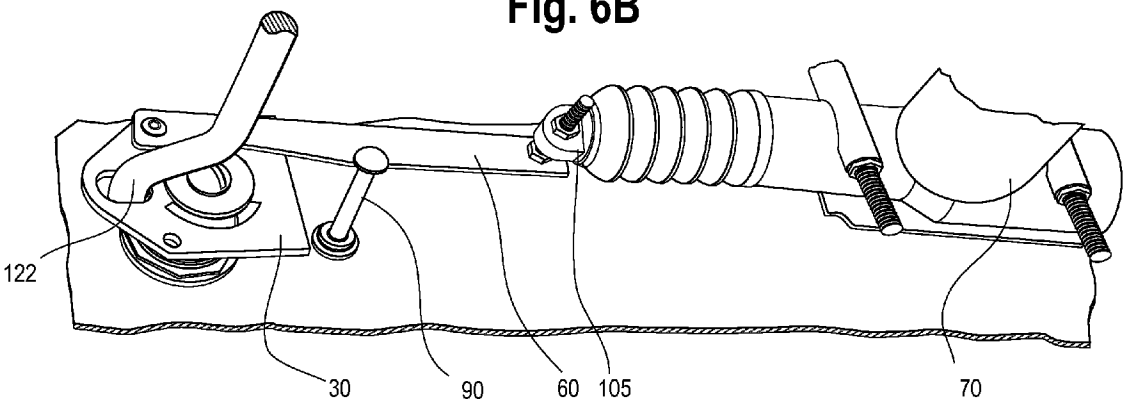

FIGS. 6A-6B illustrate in more detail how the components of the locking mechanism 300 of the embodiment interact together as they move from the "unlock" and "lock" positions. With particular reference to FIG. 6A, locking mechanism 300 is shown with drive plate 20 rotated by a key (not visible) to the manual "unlock" position (90° clockwise as viewed from inside tool storage unit 200 with drawers removed), thus demonstrating how the contact of linkage arm 60 with pin 90 prevents lockrod 80 from pulling lockrod actuator 30 further clockwise (as shown), which would cause the tool storage drawers to be undesirably locked. Lockrod actuator 30 biases lockrod 80, so that lockrod engagement end 122 rotates downwardly in the direction of gravity. While this embodiment prevents lockrod actuator 30 from unintentionally rotating counter-clockwise (as viewed) into the "lock" position, it is not the only way for retaining lockrod actuator 30 in the "unlock" position, as shown in other alternate embodiments.

Figure 7A:
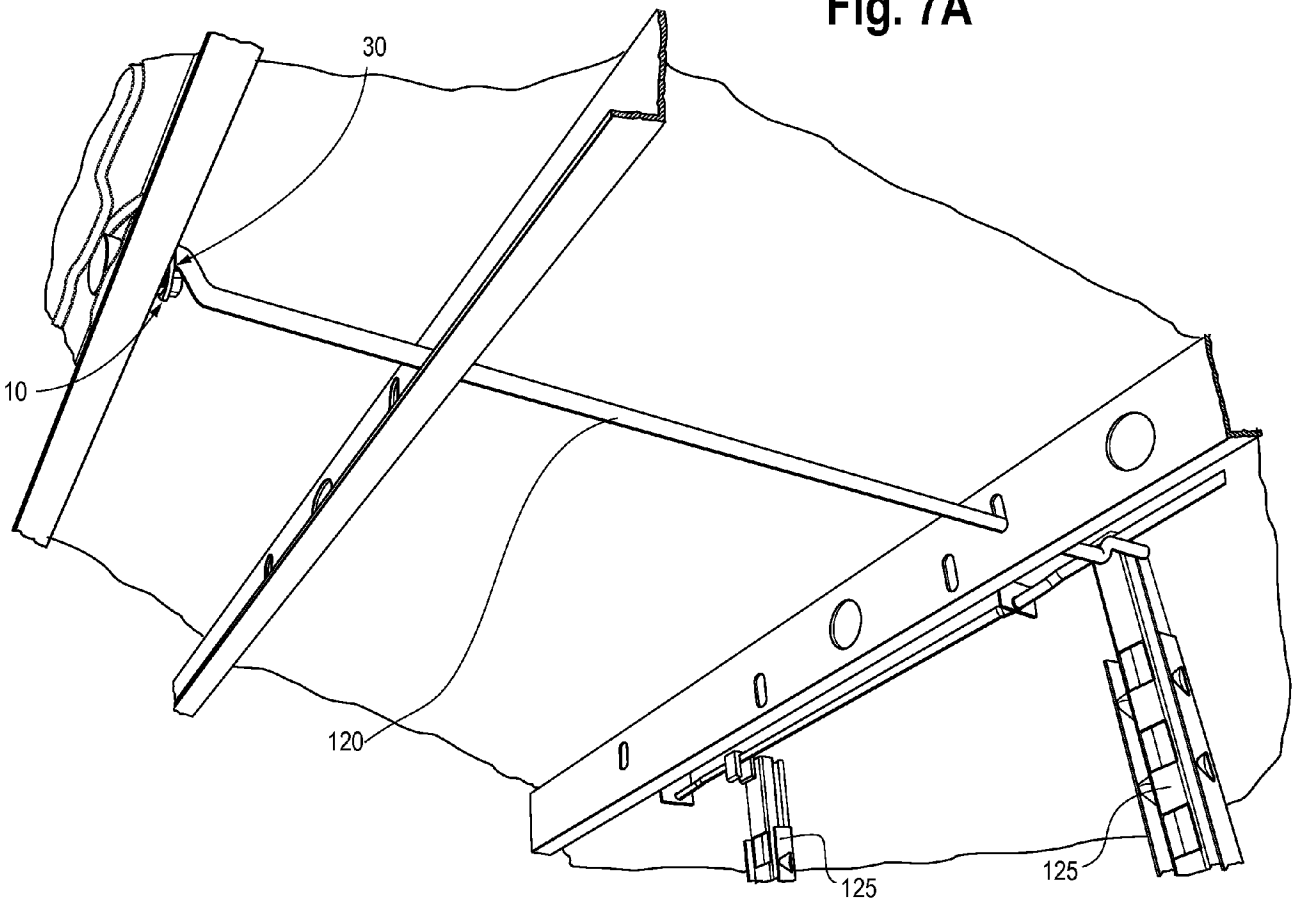
FIGS. 7A to 7B are close-up views of the interaction of the drawer hook with the lockbar of the locking mechanism in FIG. 6 in "locked" and "unlocked" positions.
Figure 7B:
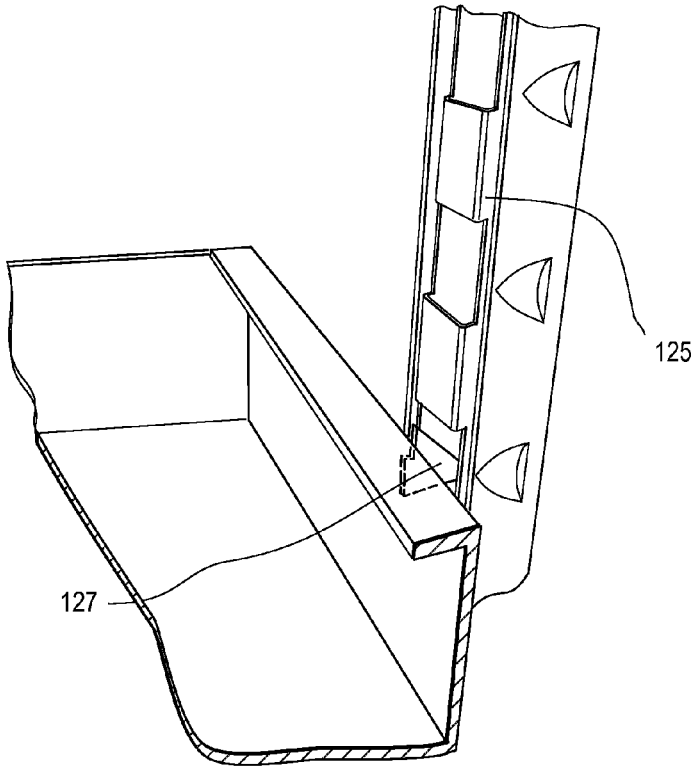
Figure 8:
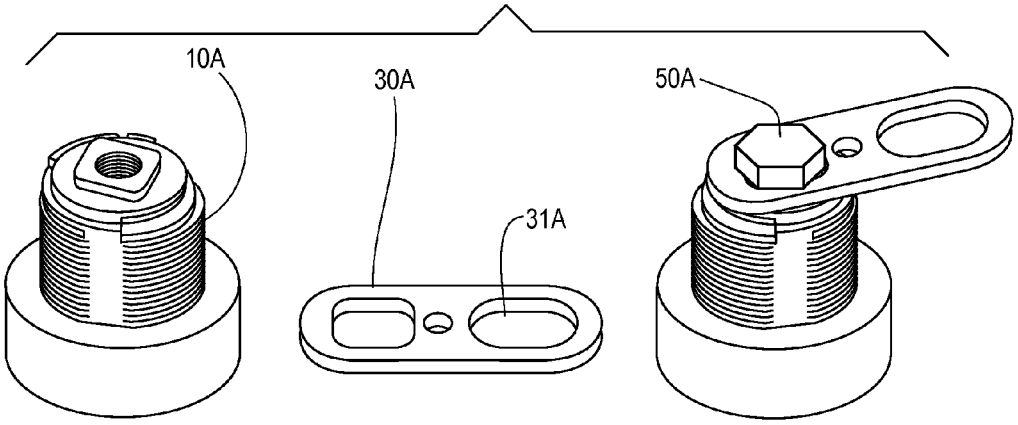
FIG. 8 is a view of the components and assembly of a standard lock which is replaced by the locking mechanism for remote activation in accordance the present disclosure.
Figure 9A:
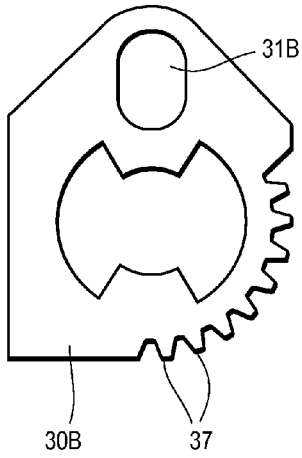
FIGS. 9A to 9C are views of component parts for the locking mechanism for remote activation in accordance with other embodiments of the present disclosure.
Figure 9B:
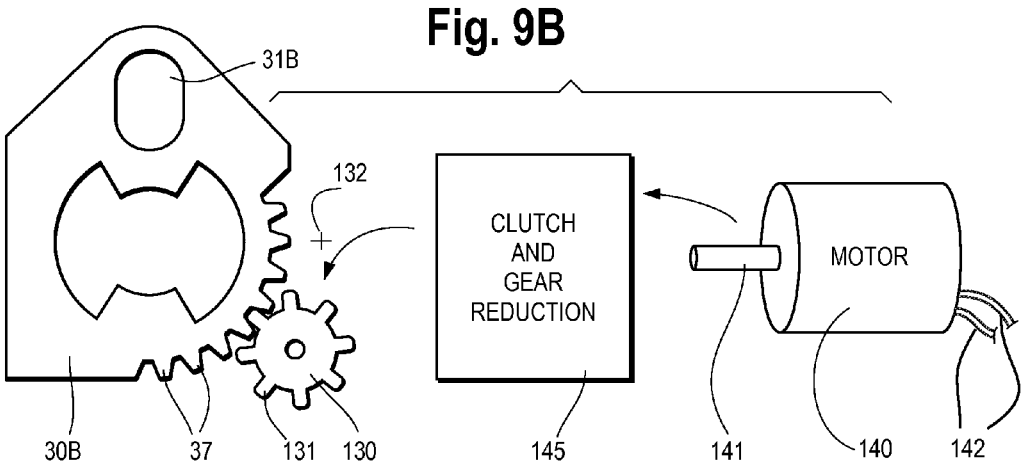

FIGS. 7A-7B illustrate further details of an embodiments which shows an internal view of tool storage unit 200 looking inwardly (from left to right) toward the rear of unit 200, where the drawers would be positioned in front of lockbars 125 (seen also in FIG. 1). More particularly, FIG. 7A shows the locking mechanism 300 in the "unlock" position, which includes lockrod actuator 30, lock cylinder 10, lockrod 120 extending across unit 200, and a crossrod that can be shifted laterally along its axis to move lockbars 125 out of engagement with the draw hooks 127 of the drawers (shown more clearly in FIG. 7B). FIG. 8 illustrates a standard lock cylinder 10A, lockrod actuator 30A, oblong opening 31A, and screw 50A to "unlock" and "lock" positions. FIGS. 9A-9B illustrate another embodiment with a modified lockrod actuator 30B and intermeshing components that, when connected between lock cylinder 10 (not shown) and lockrod 120 (not shown) of a tool storage unit 200, likewise allow for independent locking and unlocking of the unit by key and/or remote system. More particularly, alternate lockrod actuator 30B includes gear teeth 37 that intermesh compatibly with gear teeth of a drive plate (not shown) and pinion gear 130 to rotate the alternate lockrod actuator 30B. The drive plate rotates about and concentric to pivot point 132, along an arc that extends from directly below pivot point 132 to a point slightly above a horizontal line that intersects pivot point 132, thus drawing an arc of slightly larger than 90°. By placing pinion gear 130 at a point along the same horizontal line, so that pinion gear teeth 132 mesh with gear teeth 37 (not in the location where pinion 130 is illustrated in FIG. 9B), lockrod actuator 30B is able to rotate (relative to its illustrated position) between 90° counter-clockwise—the "lock" position—and slightly clockwise (about 5-10°)—the "unlock" position.

Gravitational forces acting on the lockrod and locking mechanism with which it engages in this embodiment tend to rotate the lockrod so that its engagement end 122, which connects to lockrod actuator 30B through oblong opening 31B at the top of lockrod actuator 30B (like the other alternate embodiments), falls downward. If lockrod actuator 30B is positioned squarely so that first hinge point 100 (not shown) is directly below lockrod engagement end 122, then external vibrations imparted upon the tool storage unit could generate lateral forces, which may cause lockrod actuator 30B and the lockrod to rotate unintentionally to the "lock position." By allowing lockrod actuator 30B to rest with lockrod engagement end 122 slightly clockwise of first hinge point 100, the lockrod is biased so the gravitational forces acting on it aid in preventing unintentional rotation of lockrod actuator 30B and the lockrod to the "lock" position.

Pinion gear 130 may be rotated by bi-directional DC electric motor 140 with its output shaft 141 linked to pinion 130, possibly (but not necessarily) with speed reduction gearing 145 between motor 140 and pinion gear 130. The direction of motor 140 and pinion 130 rotation is determined by the polarity of the voltage applied to the motor input terminals 142. It will be understood that the embodiments described herein may include or be utilized with any appropriate voltage or current source, such as a battery, an alternator, a fuel cell, and the like, providing any appropriate current and/or voltage, such as about 12 Volts, about 42 Volts and the like.

An important part of the lock mechanism of this alternate embodiment is the presence of a clutch as part of speed reduction gearing 145 between motor output shaft 141 and pinion gear 130, so the two are coupled when power is applied to motor 140, and decoupled at all other times. Decoupling is required so pinion gear 130 does not restrict the ability of a user to rotate lockrod actuator 30B by turning a key inserted into the lock cylinder, thus rotating the drive plate (not shown) and engaging lockrod actuator 30B. The form of the clutch could be a retractable friction coupling, centrifugal coupling, magnetic coupling, electro-magnetic coupling, or other coupling methods.

Figure 9C:
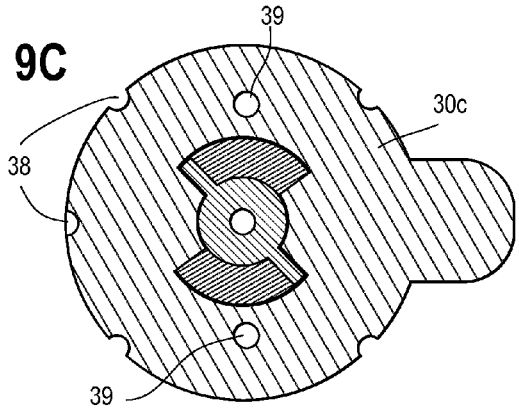

FIG. 9C shows another alternative lockrod actuator 30C for a locking mechanism that can be used, but does not necessarily have to be used, with a tool unit of the locker type, which includes detents 38 around the periphery of the lockrod actuator to help prevent accidental rotation of the actuator, and upper and lower holes 39 for engagement with the lockrods of the tool unit.

Figure 10A:
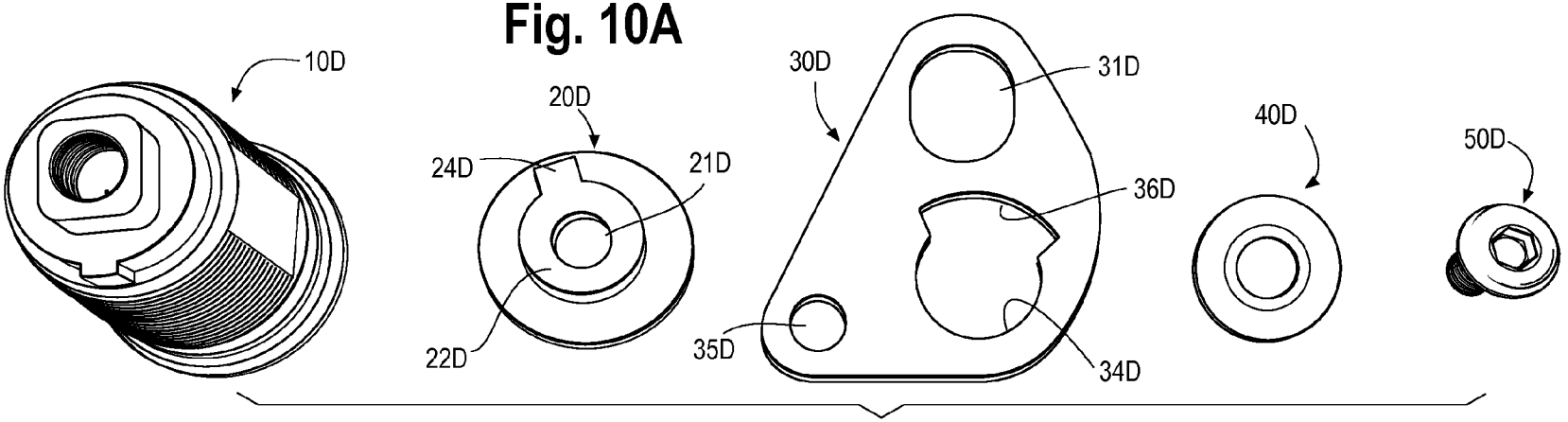
FIGS. 10A to 10B are views of component parts for the locking mechanism for remote activation in accordance with another embodiment of the present disclosure.
Figure 10B:
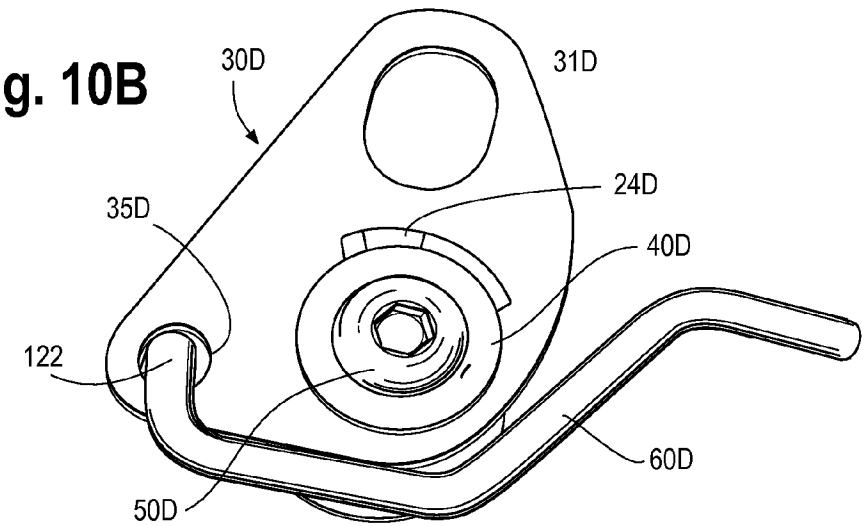

FIGS. 10A-10B illustrate another embodiment with a modified lockrod actuator 30D and drive plate 20D. Lockrod actuator 30D contains three openings, oblong opening 31D, a small opening hole 35D, and a larger centrally-located hole 34D that fits over drive plate 20D, creating an effective lost motion cam. The smaller radius portion of hole 34D rides over the smaller cylindrical portion 22D of drive plate 20D, while the larger radius portion 36D creates an area of free rotation of tooth 24D at the smaller cylinder of drive plate 20D.

Figure 11A:
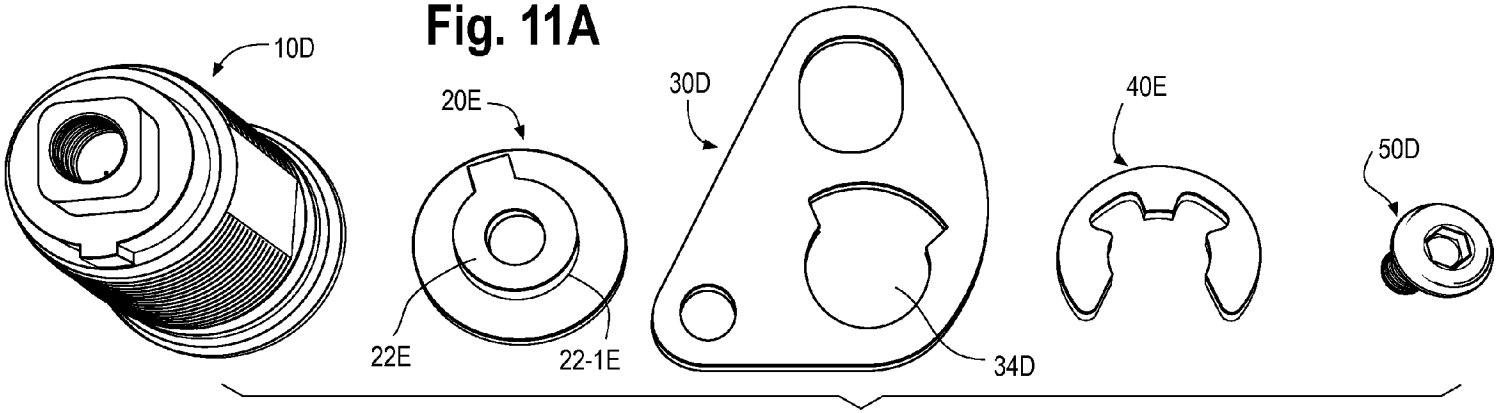
FIGS. 11A to 11B are views of component parts for the locking mechanism for remote activation in accordance with another embodiment of the present disclosure.
Figure 11B:
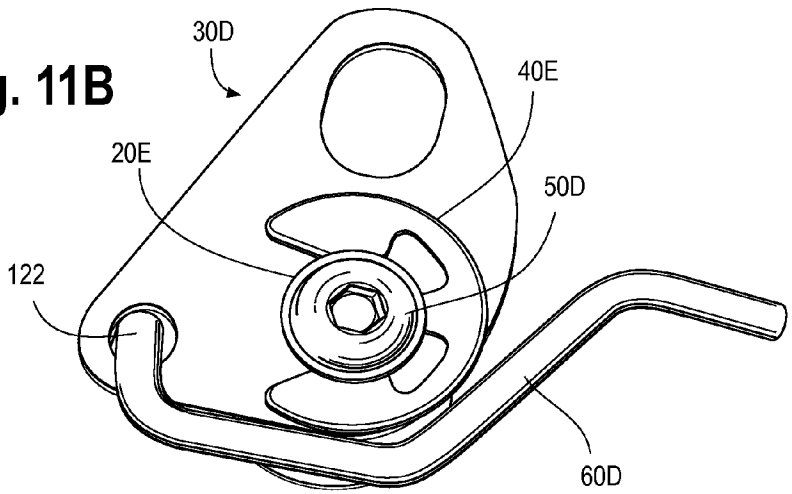

FIGS. 11A-11B illustrate another embodiment, with cylindrical portion 22E of drive plate 20E extending further beyond the thickness of lockrod actuator 30D, so it can accept an E-style snap ring 40E. The position of a groove 22-1E in the extended cylindrical portion 22E locates the snap ring 40E so it retains lockrod actuator 30D on drive plate 20E without causing friction that would prevent the rotation of lockrod actuator 30D around the central axis of drive plate 20E. An advantage of this alternate embodiment includes assembly of lock cylinder 10D, drive plate 20E, and screw 50D prior to attachment of lockrod actuator 30D, that can be more easily positioned into place than other embodiments, at which time E-style snap ring 40E can be pressed into place, completing the assembly. Additionally, if the major diameter of drive plate 20E is smaller than the inner thread diameter of lock cylinder 10E, then components 10D, 20E, and 50D can be pre-assembled outside the tool storage unit, and inserted through lockrod actuator central opening 34D.

As discussed, the embodiments of the present disclosure are designed to be activated remotely by the application of voltage to a DC motor, and that the polarity of the applied voltage determines the direction of travel of the locking mechanisms to either lock or unlock the tool storage unit to which the mechanisms are applied. An illustrative method and circuit in FIG. 12 provides a bi-directional voltage for causing movement of linear actuator 70, like those available from a variety of manufacturers, such as Spal, M.E.S., Tesor, Omega, and others, that are capable of generating linear forces in the range of 8 to 15 lbs., and are designed to operate from a 12 VDC supply, as is common in the automotive market.

Figure 12:
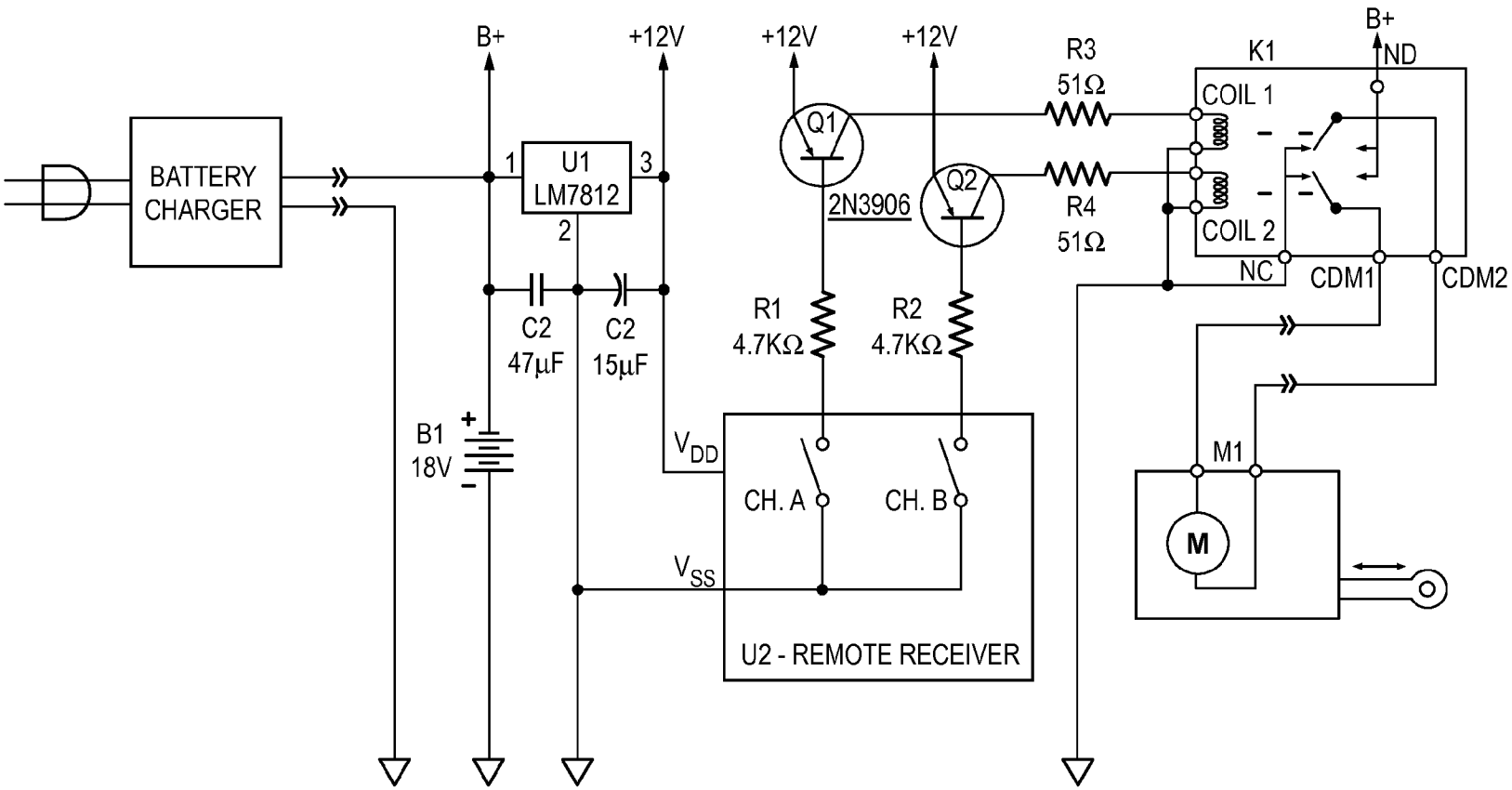
FIG. 12 is a schematic drawing of a circuit for driving the linear actuator of the locking mechanisms for remote activation in accordance with embodiments of the present disclosure.

The circuit in FIG. 12 comprises three main sections or sub-circuits: a power supply; a remote control transmitter/receiver system; and a drive circuitry and linear actuator. The function and specifications of each will now be described.

Power Supply

The function of this sub-circuit is to deliver and maintain power to the rest of the circuitry. Power for the system is derived from B1, which is an 18 VDC battery pack, composed of nickel-cadmium or nickel-metal hydride, fuel or other power producing cells. The output of this battery pack is designated B+. Battery pack B1 is charged by a battery charger, preferably a "trickle charger" capable of maintaining an average input current of about 40 mA to battery pack B1. Such a charger may derive, for example, power from AC outlets. Regulator U1 provides a secondary supply voltage of 12 VDC, necessary for powering the remote receiver U2. Capacitor C1 prevents intra-regulator oscillations, while C2 provides output filtering.

Remote Control Transmitter/Receiver System

The purpose of this sub-circuit is to provide a remote hand-held triggering device (transmitter), which is mated to a receiver that recognizes only those transmitters that generate a properly-coded signal. The receiver converts these signals into switch contacts that are used by the drive circuitry to operate the linear actuator. The transmitter (not shown in the schematic drawing) is of the type typically used in the automotive market: small, easily stored in a pocket, containing a plurality of buttons including one for locking and one for unlocking the tool storage unit to which the circuitry and associated locking mechanisms are installed. Power for the transmitter is derived from a self-contained battery, such as a CR2032 or similar type battery.

Receiver U2 recognizes the properly-encoded signals produced by the transmitter. When the transmitter's "lock" button is pushed, receiver U2 (if within receiving range of the RF signal produced by the transmitter) recognizes the signal and closes a contact (CH. A), and maintains the switch closure until the signal terminates ("lock button" released). When the transmitter's "unlock" button is pushed, receiver U2 recognizes the signal and closes a second contact (CH. B), and maintains the switch closure until the signal terminates. Power for receiver U2 is supplied by a 12 VDC output of regulator U1 (pin 3). The contact closures described may be performed by discrete relay closure or by activation of a bipolar or MOSFET transistor, and is dependent upon design of the receiver manufacturer.

Drive Circuitry and Linear Actuator

The purpose of this sub-circuit is to convert the discrete switch closures from receiver U2 to a bidirectional voltage applied to the terminals of linear actuator M1 for selective extension or retraction of linear actuator 70 of the various embodiments. Transistors Q1 and Q2 are PNP-type bipolar transistors, typically 2N3906, which are used as current buffers. When one of the switch closures occurs in receiver U2, it pulls the associated transistor's base LO, turning the transistor ON and allowing current to flow from the emitter, which is tied to 12 VDC to the collector, which energizes one of two coils in the relay K1. Resistors R1 and R2 limit the transistor base current, while resistors R3 and R4 limit the collector current.

Relay K1 is a twin-power automotive relay, such as, for example, the Panasonic CF2-12V, and is typically used in automotive applications like power windows and seat positioning, where bi-directional control is required. When no current is flowing through either coil, both relay outputs (COM1 and COM2) are tied to circuit ground through the NC contact. If receiver U2 switch CH. A is ON, then transistor Q1 is ON, allowing current to flow through and energize K1 Coil 1. This connects the output COM1 to B+, thus applying a COM1-HI polarity to the motor of linear actuator M1, causing linear actuator 70 of the disclosed embodiments to extend, which moves locking mechanism 300 into the "lock" position. Conversely, if receiver U2 switch CH. B is ON, then transistor Q2 is ON, allowing current to flow through and energize K1 Coil 2. This connects the output COM2 to B+, thus applying a COM2-HI polarity to the motor of linear actuator M1, causing the linear actuator to retract, which moves the locking mechanism 300 into the "unlock" position.

Logic built into receiver U2 typically prevents multiple switch contacts (e.g., CH. A and CH. B) from occurring simultaneously. However, if by some manner both coils 1 and 2 of relay K1 were to be energized concurrently, both outputs COM1 and COM2 would be tied to B+, causing no response from linear actuator M1.

Of course, the foregoing description of the circuitry illustrated in FIG. 17 is not meant to be limiting in its content. For example, and not by way of exclusion, battery pack B1 could be replaced or augmented by an AC to DC power supply, or by a CTB6185 battery pack used, for example, with Snap-On® brand cordless power tools. Transistors Q1 and Q2 could be replaced by P-channel MOSFET transistors, or eliminated completely if the switching methods contained within receiver U2 are capable of driving the coils of relay K1 directly. The remote transmitter may contain more than two buttons for additional operations. The circuitry may contain a microcontroller for providing higher levels of control.

There are a number of remote or automatic systems for electronic control of the locking mechanisms of the disclosed embodiments to either lock or unlock the tool storage units. In an illustrative embodiment, a passive keyless entry (PKE) system is employed in which a user has a wireless device attached to his person. A transceiver used as part of the remote locking system detects the presence of the wireless device when it is within a finite distance (e.g. 30 feet or 50 yards) of the transceiver. When the device is recognized by the system, the mechanism unlocks the tool storage unit. When the device ceases to be recognized, the mechanism locks the unit. Wireless devices may include devices that transmit a properly coded signal when activated by the system transceiver, radio frequency (RF), radio frequency identification (RFID), a Bluetooth® enabled device such as a cellular phone, or other proximity-detecting devices.

Such a wireless network solution may be applied to high-security locations, where a central computer would communicate through a wireless hub (similar to a wireless internet hub) with multiple tool storage units containing wireless ports (similar to a laptop network card). A supervisor could remotely lock or unlock tool storage units throughout a facility, perhaps in coordination with security cameras and/or intercom and/or family radio service/general mobile radio service (FRS/GMRS) radios.

Wireless network solutions can be used also on smaller scales. Smart phones may include applications that could communicate with remote locking system controls of the disclosure. As stated, other handheld devices can also communicate remotely with the system. Biometric control that uses unique human identification devices, such as fingerprint readers or retina scanners, can be used to unlock the tool storage units. Relocking can be done by timed access, push-button locking, or biometric activation.

Another power system embodiment for the remote locking system of the disclosure could be wireless power transmission, where power is transferred wirelessly from a transmitter to a receiver. A typical method for wireless power transmission is inductive coupling, where one coil is energized by an AC source, producing an alternating electromagnetic field. A second coil, located inside the tool storage unit, is tuned for maximum efficiency at the frequency produced by the transmitting coil. The alternating electromagnetic field inductively couples the two coils, much as occurs between the primary and secondary coils in a transformer. The advantage of wireless power transmission to tool storage units is that no holes are required to bring power into the unit.

Figure 13:
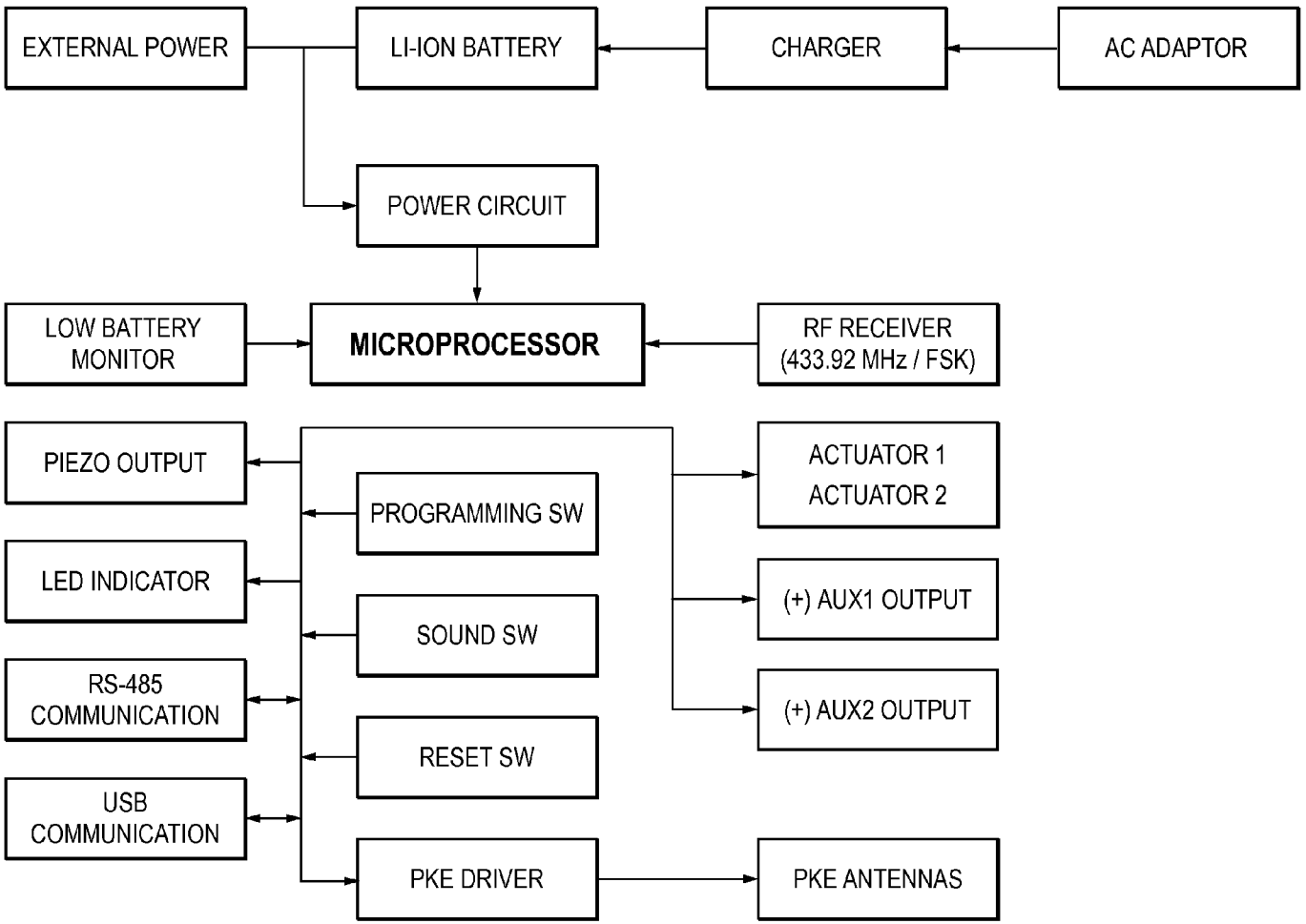
FIG. 13 is a block diagram of a wireless remote control system for a passive keyless entry utilizing received signal strength indication field strength measurements in accordance with embodiments of the present disclosure.

The foregoing wireless remote control system with PKE can utilize received signal strength indication (RSSI) field strength measurements to determine the distance of the user from the tool storage unit. This can be done by incorporating USB loading and retrieving data from the master control module along with control area network bus (CANBUS) and serial communication to future peripheral devices. An illustrative PKE system consists of the following, as illustrated in the block diagram of FIG. 13: Lithium-ion battery pack; A/C adapter; charge control circuit for the battery pack; main PCB with 433 MHz and 125 kHz (2) way RF communication; external and internal ferrite core copper antennas; remote RF transmitter with PKE capability; automotive-style linear actuator; and custom-designed plastic enclosure, that can be housed inside a tool storage unit, behind the dress plate.

The serial and CANBUS interface can be used in an almost unlimited number of present and future devices and to allow control from such devices as mobile phones, PDA's, and other RF capable devices, as previously disclosed, including (but not limited to) Bluetooth, Zigbee, Wi-Fi, and other future wireless protocols. Software can be employed to learn the transmitter along with other software configurations in a tool storage unit. Transmitter learning consists of learning the encryption key, then the hex codes for each button pushed which must see four (4) hex files per transmitter to have a valid learning sequence.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A lock mechanism comprising:

a lock cylinder;

a lockrod actuator coupled to the lock cylinder and adapted to rotate between first and second angular displacements, the lockrod actuator having a first hinge point and an opening, each of which is spaced from a center of the lockrod actuator;

a linkage arm coupled to the lockrod actuator at the first hinge point and having a second hinge point spaced from the first hinge point;

a linear actuator adapted to cause axial movement of the linkage arm to cause the lockrod actuator to rotate;

a lockrod extending through the opening and adapted to move between first and second orientations; and a pin disposed adjacent to the lockrod actuator and adapted to bias the linkage arm in an upwardly direction against gravitational forces in response to axial movement of the linkage arm in a direction toward the lockrod actuator.

2. The lock mechanism of claim 1, further comprising:

a drive plate coupled to an output portion of the lock cylinder disposed between the lock cylinder and the lockrod actuator, the drive plate including a projection and adapted to rotate the output portion;

the lockrod actuator including a keyway adapted to receive the projection;

the projection and keyway adapted to cooperatively angularly displace the lockrod actuator from an unlocked orientation to a locked orientation in response to a first rotation of the drive plate from a neutral position in a locking direction, and to allow the lockrod actuator to remain in the locked orientation in response to subsequent rotations of the drive plate in the locking direction.

3. The lock mechanism of claim 2, wherein the projection and keyway are adapted to cooperatively angularly displace the lockrod actuator from the locked orientation to the unlocked orientation in response to a second rotation of the drive plate from the neutral position in an unlocking direction, and to allow the lockrod actuator to remain in the unlocked orientation in response to subsequent rotations of the drive plate in the unlocking direction.

4. The lock mechanism of claim 1, further comprising:

power supply circuitry in communication with the linear actuator, the power supply circuitry including polarity reversing circuitry adapted to provide a voltage having a first polarity for driving the linear actuator in a first direction and a second polarity for driving the linear actuator in a second direction.

5. The lock mechanism of claim 4, wherein the power supply circuitry is adapted to wirelessly transmit power to the linear actuator.

6. The lock mechanism of claim 4, further comprising:

control circuitry in communication with the power supply circuitry, the control circuitry adapted to receive a command signal and to cause the power supply circuitry to switch between the first and second polarities.

7. The lock mechanism of claim 6, further comprising:

actuation command circuitry in wireless communication with the control circuitry, the actuation command circuitry adapted to transmit the command signal in response to an actuation event.

8. The lock mechanism of claim 7, wherein the actuation command circuitry is selected from the group consisting of proximity sensing circuitry, passive keyless entry circuitry, wireless network circuitry and biometric control circuitry.

9. The lock mechanism of claim 8, further comprising:

radio signal strength indication (RSSI) circuitry adapted to detect a distance between a location of the lock mechanism and a user location.

10. The lock mechanism of claim 9, wherein the actuation command circuitry is adapted to transmit an unlock command to the control circuitry in response to detecting the distance within a first range, and to transmit a lock command to the control circuitry in response to detecting the distance within a second range.

11. The lock mechanism of claim 1, wherein the lock cylinder is adapted to retrofit in place of a standard lock cylinder.

12. A lock mechanism including:

a lock cylinder;

a lockrod actuator having a keyway, the lockrod actuator coupled to the lock cylinder and adapted to rotate between first and second angular displacements, the lockrod actuator having a first hinge point and an opening each spaced from a center of the lockrod actuator;

a linkage arm coupled to the lockrod actuator at the first hinge point and having a second hinge point spaced from the first hinge point;

a linear actuator coupled to the second hinge point and adapted to cause axial movement of the linkage arm thereby to cause the lockrod actuator to rotate upon application of the axial movement;

a lockrod extending through the opening and adapted to move between first and second orientations corresponding to rotation of the lockrod actuator;

a pin disposed adjacent the lockrod actuator and adapted to bias the linkage arm in an upwardly direction against gravitational forces in response to axial movement of the linkage arm in a direction toward the lockrod actuator;

a drive plate coupled to an output portion of the lock cylinder disposed between the lock cylinder and the lockrod actuator, the drive plate including a projection adapted to engage the keyway and rotate the output portion;

radio signal strength indication (RSSI) circuitry adapted to detect a distance between a location of the lock mechanism and a user location;

power supply circuitry in communication with the linear actuator, the power supply circuitry including polarity reversing circuitry adapted to provide a voltage having a first polarity for driving the linear actuator in a first direction and a second polarity for driving the linear actuator in a second direction;

control circuitry in communication with the power supply circuitry, the control circuitry adapted to receive a command signal and to cause the power supply circuitry to switch between the first and the second polarities in response to receiving the command signal; and actuation command circuitry in wireless communication with the control circuitry, the actuation command circuitry adapted to transmit the command signal in response to an actuation event, wherein the actuation command circuitry is selected from the group consisting of proximity sensing circuitry, passive keyless entry circuitry, wireless network circuitry and biometric control circuitry and is adapted to transmit an unlock command to the control circuitry in response to detecting the distance within a first range, and to transmit a lock command to the control circuitry in response to detecting the distance within a second range, and wherein the projection and keyway are adapted to cooperatively angularly displace the lockrod actuator from an unlocked orientation to a locked orientation in response to a first rotation of the drive plate from a neutral position in a locking direction, and to allow the lockrod actuator to remain in the locked orientation in response to subsequent rotations of the drive plate in the locking direction.

* * * * *